US006070994A

United States Patent [19]

Sebek et al.

[11] Patent Number: 6,070,994

[45] Date of Patent: Jun. 6, 2000

[54] DUAL BEACON FOR MARKING OBSTRUCTIONS

[75] Inventors: Gavin D. Sebek, Houston; Donald V. Nguyen; Jeffrey A. Huehlefeld, both of Katy, all of Tex.

[73] Assignee: TRW Lighting, Inc., Houston, Tex.

[21] Appl. No.: 09/032,812

[22] Filed: Mar. 2, 1998

[51] Int. Cl.[7] ..... F21V 5/00

[52] U.S. Cl. ..... 362/332; 362/311; 362/244; 362/374

[58] Field of Search ..... 362/332–339, 362/311, 244, 374, 375

[56] References Cited

U.S. PATENT DOCUMENTS

| | | | |
|---|---|---|---|
| 516,824 | 3/1894 | Knowles . | |
| 1,057,770 | 4/1913 | Persky | 362/332 |
| 4,215,390 | 7/1980 | Brandt | 362/311 |
| 4,360,862 | 11/1982 | Strasser et al. | 362/311 X |
| 4,499,527 | 2/1985 | Tauber et al. | 362/311 X |
| 4,638,411 | 1/1987 | Trainor | 362/145 |
| 5,842,779 | 12/1998 | Siebert | 362/309 |

*Primary Examiner*—Laura K Tso
*Attorney, Agent, or Firm*—James A. Bargfrede

[57] ABSTRACT

A dual beacon is provided for mounting on an obstruction such as a tower. The dual beacon is substantially cylindrical with an open cylindrical interior. An upper lens section and a lower lens section is provided and at the inside top of the upper lens section there is a slight, outward and downward taper of about 1°. The upper lens section and the lower lens section are hinged to allow access to the interior where a plate has an upper flashtube assembly and a lower flashtube assembly mounted thereon. The member is hinged to allow easy access to the upper flashtube assembly and to the lower flashtube assembly. The upper lens section and the lower lens section each have a central portion which controls the intensity of the light beam. The peak intensity is in an area of 3° through 5° above a horizontal reference plane and in an area of 1° below such horizontal reference plane greater than 50% of peak intensity is provided. Each flashtube assembly includes a socket having openings which allow positioning of an elongated member over which a flashtube is positioned. Each socket is drilled with openings to accommodate wiring for the flashtubes and to provide simple yet effective mounting on the hinged member inside the dual beacon.

2 Claims, 6 Drawing Sheets

DUAL BEACON FOR MARKING OBSTRUCTIONS

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates to a dual beacon used for identifying obstructions.

II. Description of the Related Art

Dual beacons for navigational and safety purposes are known in the art. Among prior art patents is U.S. Pat. No. 5,155,666 issued Oct. 13, 1992 to Radford et al for "Light Beacon For Marking Tall Obstructions". The Radford et al patent does not disclose or suggest a hinged structure found in the present application for positioning two beacons. Also there is no showing or suggestion in Radford et al of a light beam pattern provided in the present application. Also, the present application has a custom tube socket structure not found in Radford et al or any other known prior art.

BRIEF SUMMARY OF THE INVENTION

The present invention relates to a dual beacon used for marking obstructions to aid in safety and navigation. The dual beacon is mounted in a housing having a lens designed to control the light intensity from the beacon and direct the right light in a concentrated area. The housing has an upper lens section hinged to a lower lens section. A hinged member inside the housing has a socket structure on either side of the hinged member to allow positioning of a coiled flashtube in the socket. The dual beacon of the present invention is characterized by relative simplicity, low maintenance cost, and longer flashtube life and longer lens life.

DETAILED DESCRIPTION OF THE INVENTION

Figure 1:
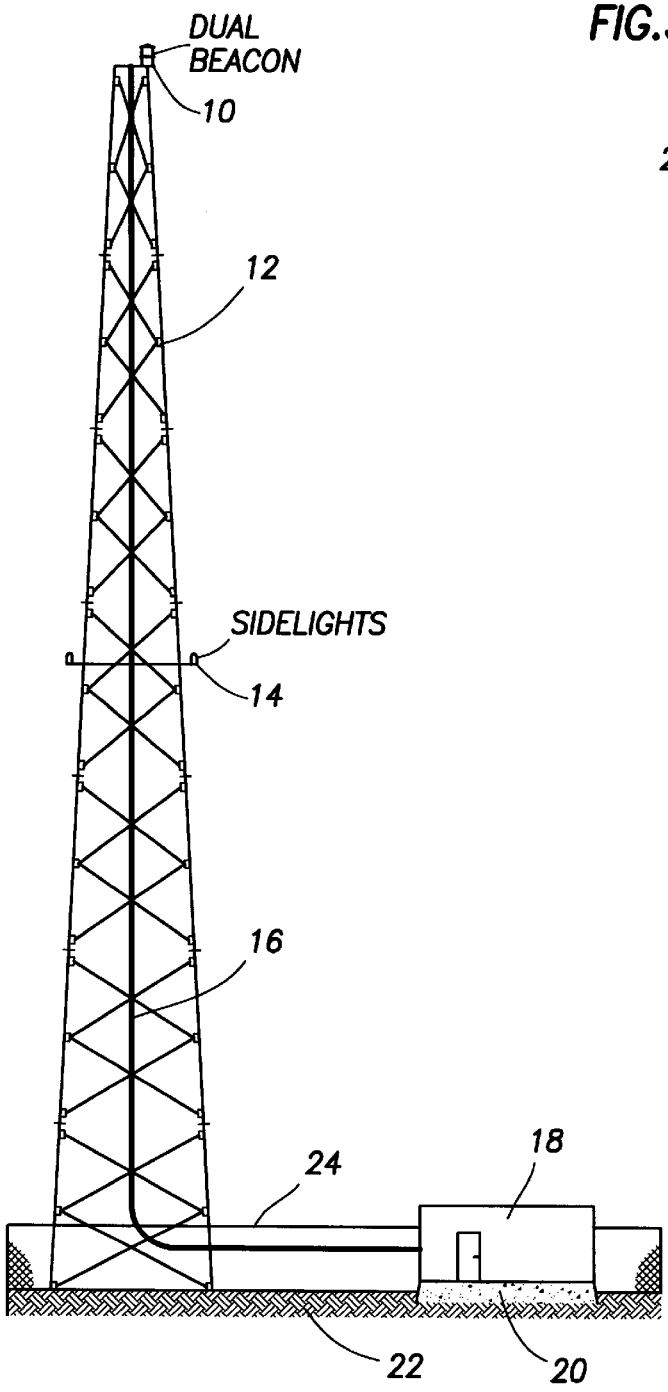
FIG. 1 is a side, elevational view of a tower arrangement having a dual beacon.

FIG. 1 is a side, elevational view of a tower arrangement having a dual beacon. Dual beacon 10 is positioned at the top of a tower 12 having a plurality of sidelights such as sidelight 14. Dual beacon 10 and the sidelights such as sidelight 14 are energized from a conductor cable 16 coming from a structure 18 built on a concrete slap 20 on ground 22. An enclosure such as a fence 24 may be built around the tower 12 and the structure 18 to protect such tower and structure from intrusion by humans or animals.

The tower 12 may be constructed of steel or other rigid material well known in the tower art.

Figure 2:
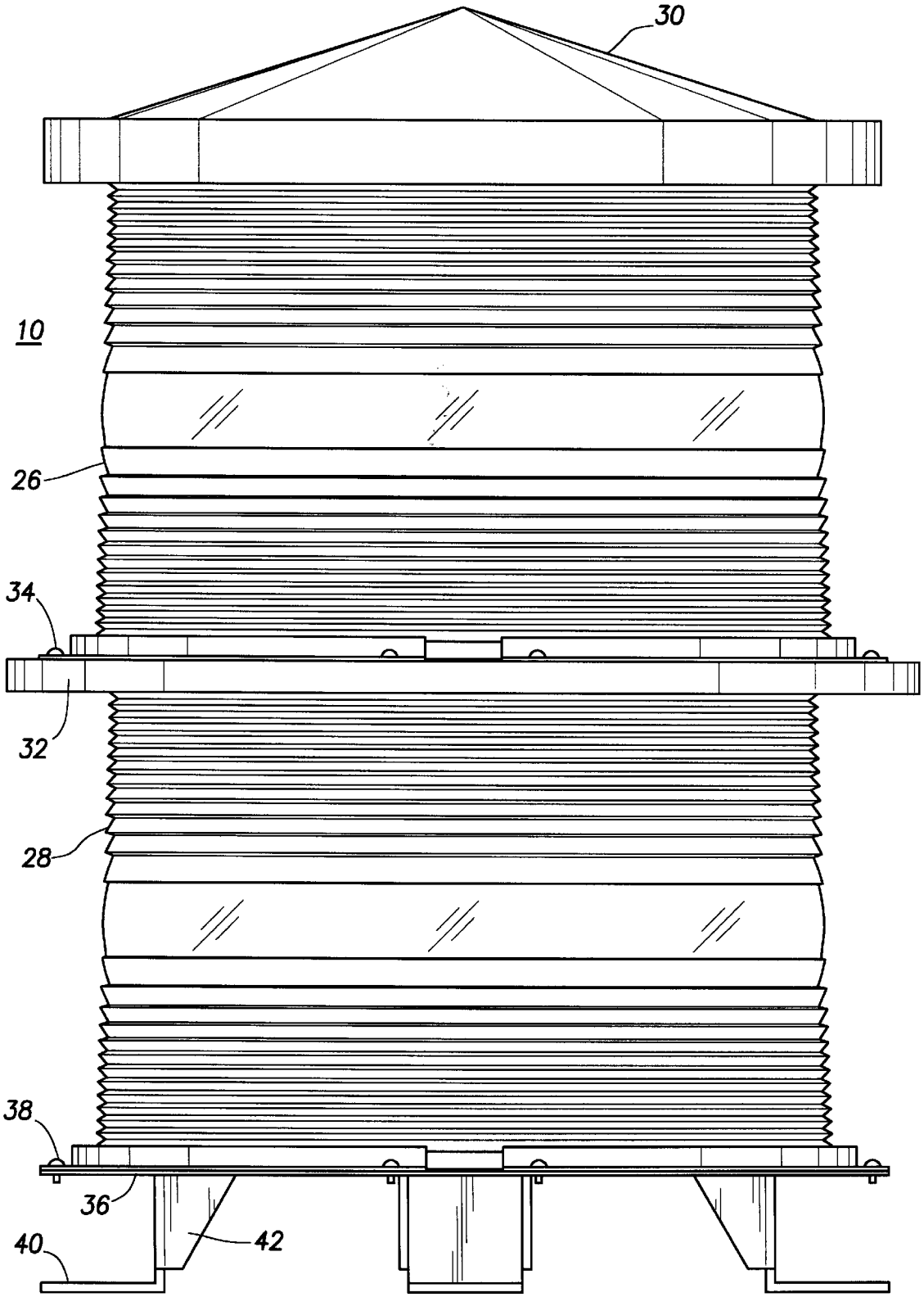
FIG. 2 is a side, elevational view of a dual beacon housing.

FIG. 2 is a side, elevational view of a dual beacon housing. Dual beacon 10 has an upper lens section 26 and a lower lens section 28. Top 30 is positioned on upper lens section 26. Member 32 is positioned at the top of lower lens section 28 and is joined to upper lens section 26 by a plurality of connectors such as connector 34. Lower lens section 28 is positioned on support 36 and held in place by a plurality of connectors such as connector 38. Support 36 has a plurality of feet such as foot 40 having a brace 42.

Dual beacon 10 shown in FIG. 2 has a lens structure which is an important part of the present invention inasmuch as light from the beacon is directed in a concentrated area as will be explained in detail subsequently.

Figure 3:
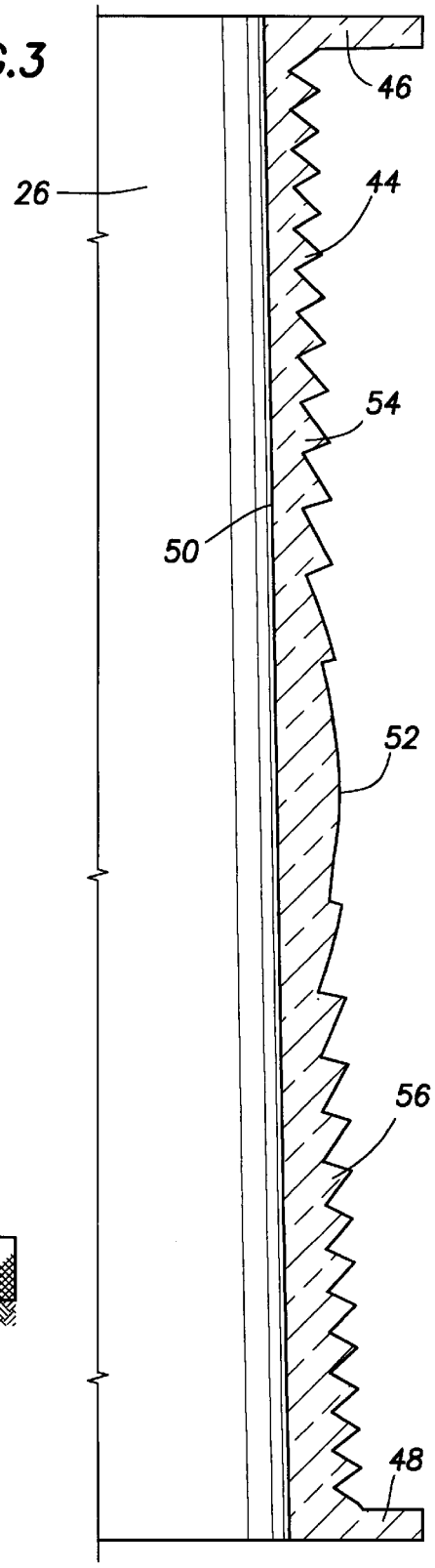
FIG. 3 is a partial sectional, side elevational view of the lens of a dual beacon.

FIG. 3 is a partial sectional, side elevational view of the lens of a dual beacon. The upper lens section 26 and lower lens section 28 shown in FIG. 2 are substantially identical. In explaining FIG. 3, the explanation of FIG. 3 will be referred to as upper lens section 26. Lens 44 has an upper lip 46 and a lower lip 48. Lens 44 may be of acrylic construction with a slight taper 50. Such slight taper may be about one degree and is in an outward direction when moving from the upper part of the lens 44 to the lower part of lens 44. There is a convex section 52 in the central part of the lens 44. A plurality of saw teeth such as saw tooth 54 protrude from the lens 44 and the protrusion in the upper portion of lens 44 is in a slight downward direction. There is a plurality of saw teeth such as saw tooth 56 in the lower portion of lens 44 and these saw teeth in the lower portion of the lens 44 extend in a slight upward direction.

The geometry of the lens 44 is an important feature of the present invention and such geometry was developed after substantial experimentation to provide an optimum light beam pattern. The slight taper 50 also is an important feature of the lens 44 structure and the amount of taper was determined after much experimentation.

Figure 4:
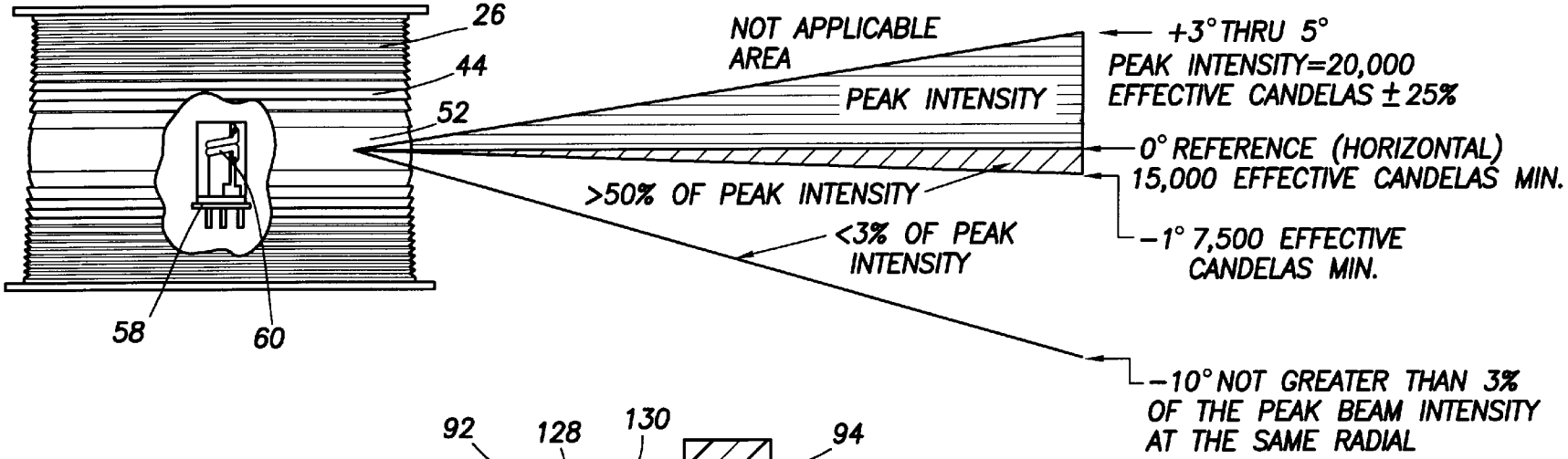
FIG. 4 is a side, elevational, partial cut-away view of the lens of a dual beacon showing the light pattern area.

FIG. 4 is a side, elevational, partial cut-away view of the lens of a dual beacon showing the light pattern area. Upper lens section 26 and lower lens section 28 of the dual beacon 10 shown in FIG. 2 are substantially identical and the explanation of FIG. 4 will be directed toward upper lens section 26 having a flashtube assembly 58 including a flashtube 60 inside of the upper lens section 26. The light from flashtube 60 passes through the convex section 52 of lens 44 and provides a light pattern as indicated in FIG. 4. The peak intensity of light is above the horizontal reference plane and is in an area of from 3° through 5°. Below the horizontal reference plane more than 50% of peak intensity is provided in the −1° area and less than 3% of peak intensity is provided at the −10° area. The light pattern is an important feature of the present invention and is provided by the configuration of the lens 44 and particularly the convex section 52.

As shown in FIG. 4, the peak intensity of the light is in the area above the horizontal reference plane in an angle from 3° through 5° with a peak intensity of 20,000 effective candelas ±25%. Below the reference plane in an angle of −1° there is greater than 50% of peak intensity with 7,500 effective candelas minimum. At −10° below the horizontal reference plane there is less than 3% of peak intensity. The concentrated beam is important to provide an effective and reliable path of light not found in prior art devices.

Figure 5:
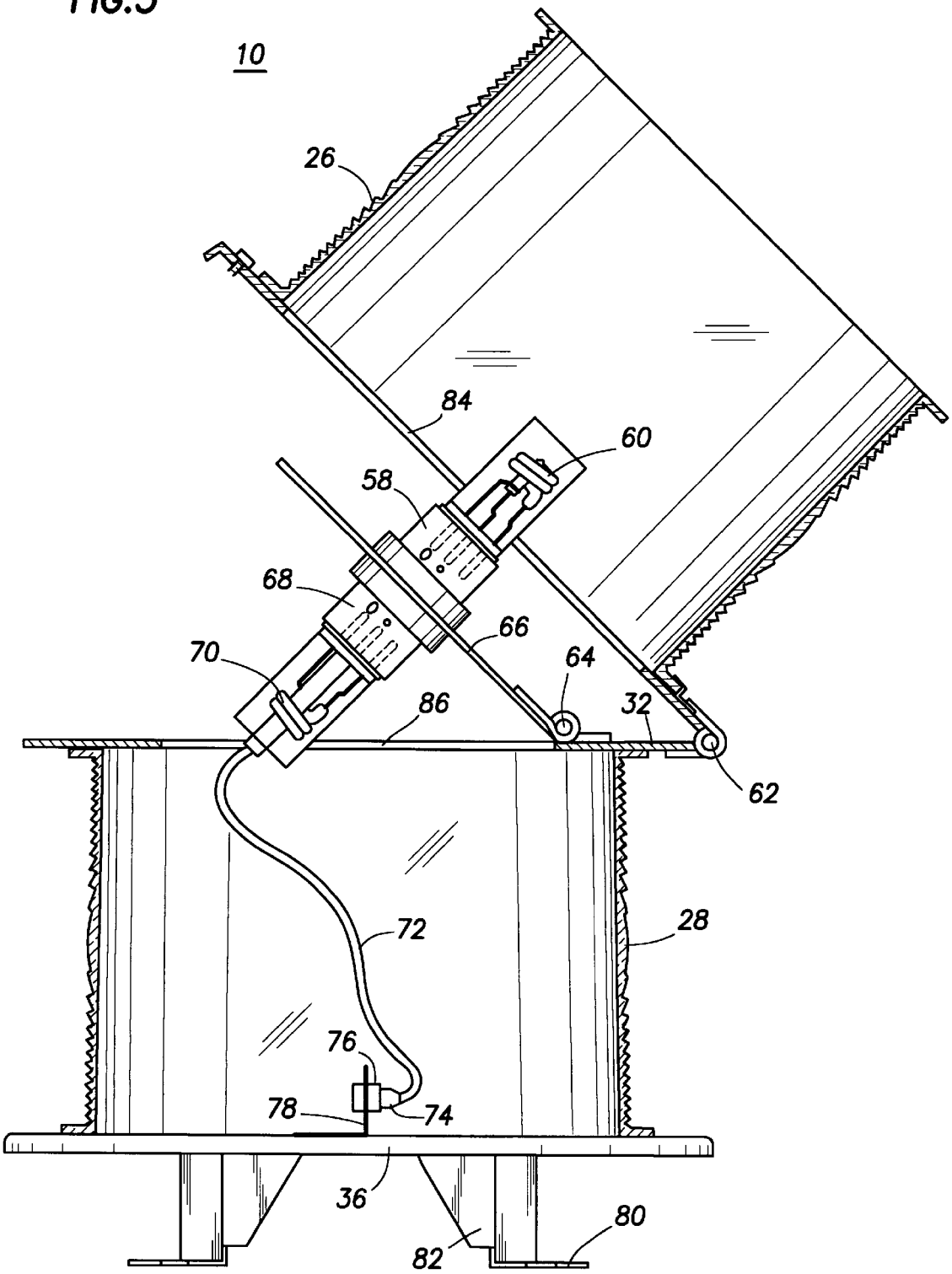
FIG. 5 is a partial sectional, side elevational view of a dual beacon housing in an open position.

FIG. 5 is a partial sectional, side elevational view of a dual beacon housing in an open position. Dual beacon 10 has upper lens section 26 connected to outer pin 62 to allow hinged movement of upper lens section 26 from lower lens section 28. Outer pin 62 is positioned on member 32 which has an inner pin 64 to allow hinged movement of plate 66 on which is mounted flashtube assembly 58 having flashtube 60. Also mounted on plate 66 is flashtube assembly 68 having flashtube 70. The flashtube assemblies are connected to conductor 72 which has a plug 74 connected to power outlet 76 mounted on angle member 78 which is connected to the support 36. Support 36 has a plurality of feet such as foot 80 and brace 82.

It will be noted that top 30 shown in FIG. 2 is not shown in FIG. 5.

The structure of the flashtube assembly 58 and flashtube assembly 68 will be explained in detail subsequently. It will be appreciated that the flashtube assembly is an important feature of the present invention inasmuch as the arrangement and results are not found or suggested in the prior art.

The dual hinged feature of dual beacon 10 is achieved by allowing upper lens section 26 to be hinged on lower lens section 28 through outer pin 62. Inner pin 64 allows plate 66 to be moved to make flashtube assembly 58 and flashtube assembly 68 easily accessible without the need to disassemble the dual beacon 10 thereby minimizing the time necessary to replace or repair components of the dual beacon 10. Opening 84 in upper lens section 26 allows flash tube assembly 58 to be positioned in upper lens section 26 and opening 86 in lower lens section 28 allows positioning of flashtube assembly 68 inside of lower lens section 28.

Figure 6:
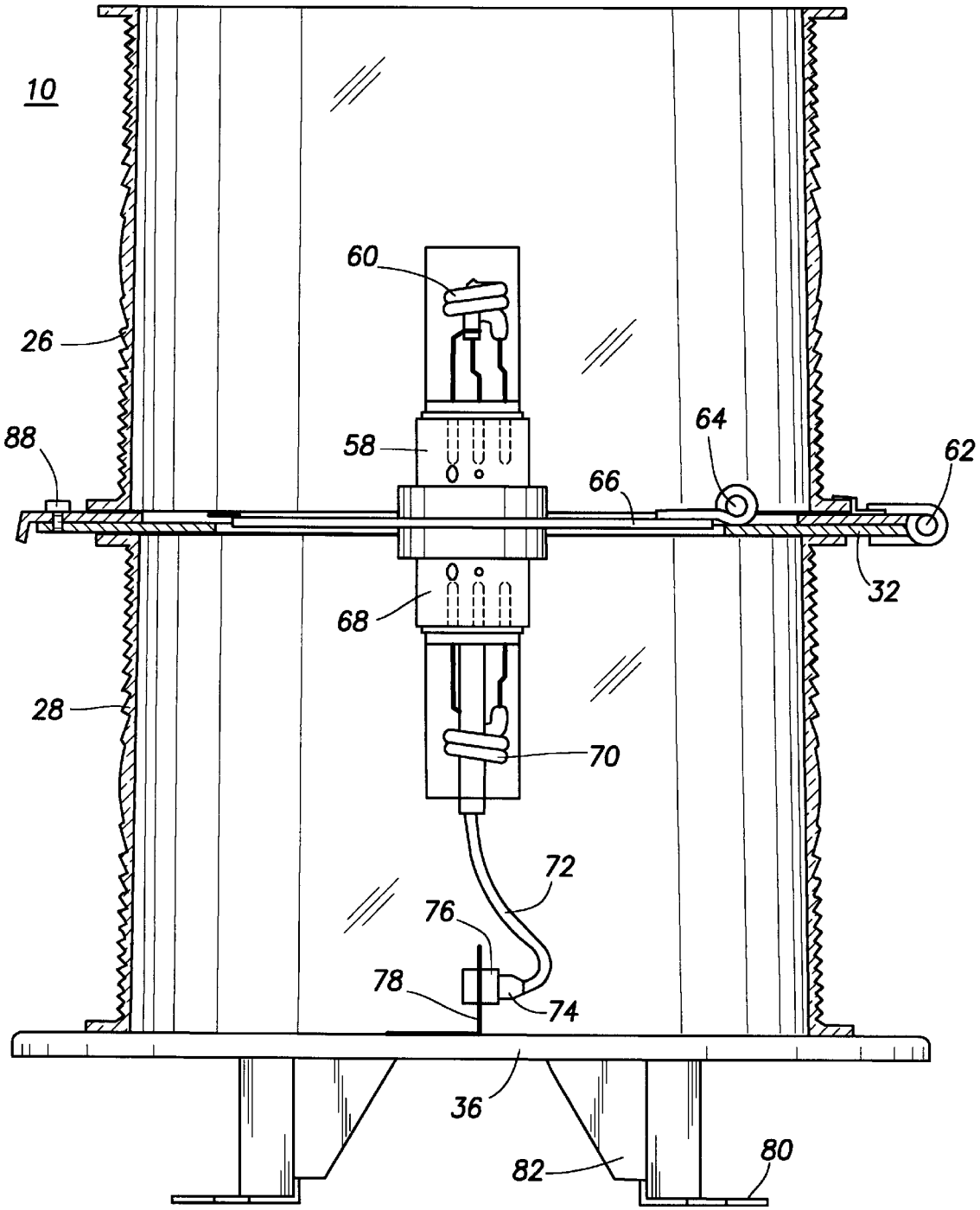
FIG. 6 is a partial sectional, side elevational view of a dual beacon housing in a closed position.

FIG. 6 is a partial sectional, side elevational view of a dual beacon housing in a closed position. FIG. 5 showed the dual beacon 10 in an open position and FIG. 6 shows upper lens section 26 positioned directly above lower lens section 28. Plate 66 is coupled to inner pin 64 to allow hinged movement of plate 66 as explained previously and outer pin 62 is coupled to member 32 to allow rigid positioning of upper lens section 26. Flashtube assembly 58 having flashtube 60 is positioned substantially vertically with flashtube assembly 68 having flashtube 70. As pointed out previously, conductor 72 is connected to plug 74 which connects to power outlet 76 on angle member 78. A connector such as bolt 88 provides rigid positioning of the upper lens section 26 and lower lens section 28 when the dual beacon 10 is in a closed position.

At the lower part of lower lens section 28 is support 36 attached to a plurality of feet such as foot 80 connected to brace 82.

When dual beacon 10 is in a closed position as shown in FIG. 6, the source of light from the upper lens section 26 and the lower lens section 28 has a light intensity arrangement explained in connection with FIG. 4.

Figure 7:
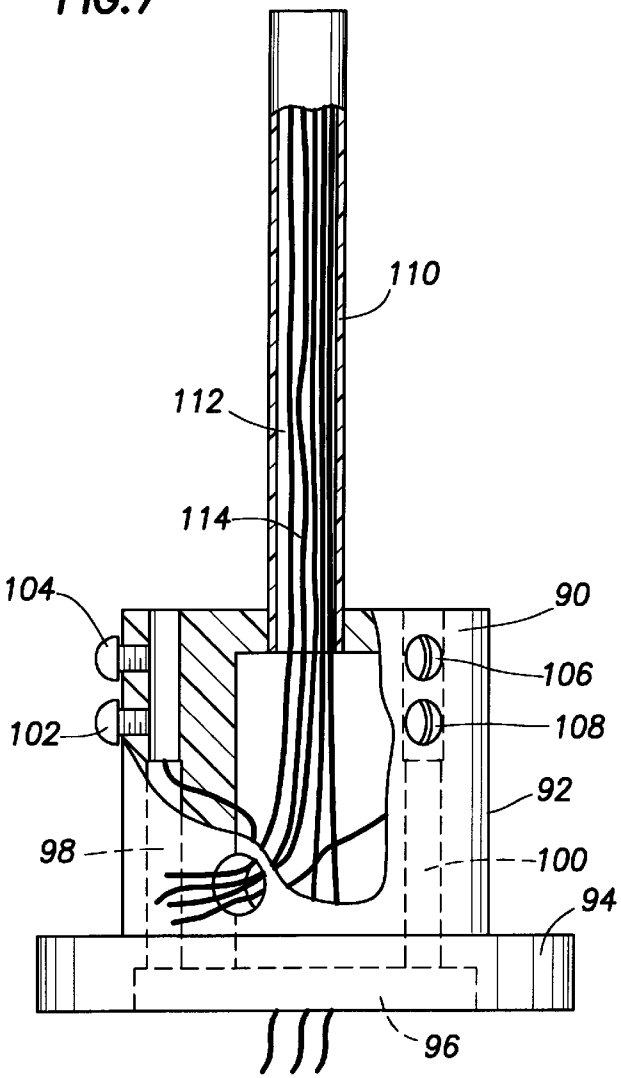
FIG. 7 is a partial sectional, side elevational view of a dual beacon flashtube socket.

FIG. 7 is a partial sectional, side elevational view of a dual beacon flashtube socket. Socket 90 is constructed of rigid material such as steel and has an upper cylindrical shaped section 92 and a concentric, lower cylindrical shaped section having a greater diameter than section 92 and is referred to as base 94. Base 94 has a cylindrical shaped recess 96 with opening 98 and opening 100 extending from recess 96 upwardly. Bolt 102 and bolt 104 are positioned in the upper part of section 92 and hole 106 and hole 108 provide positioning of additional bolts not shown but similar to bolt 102 and bolt 104.

Elongated member 110 or tube is cylindrical in configuration and has an opening 112 extending throughout the length of elongated member 110. A plurality of wires 114 are positioned in opening 112 to provide power to the flashtube which is not shown in FIG. 7.

Figure 8:
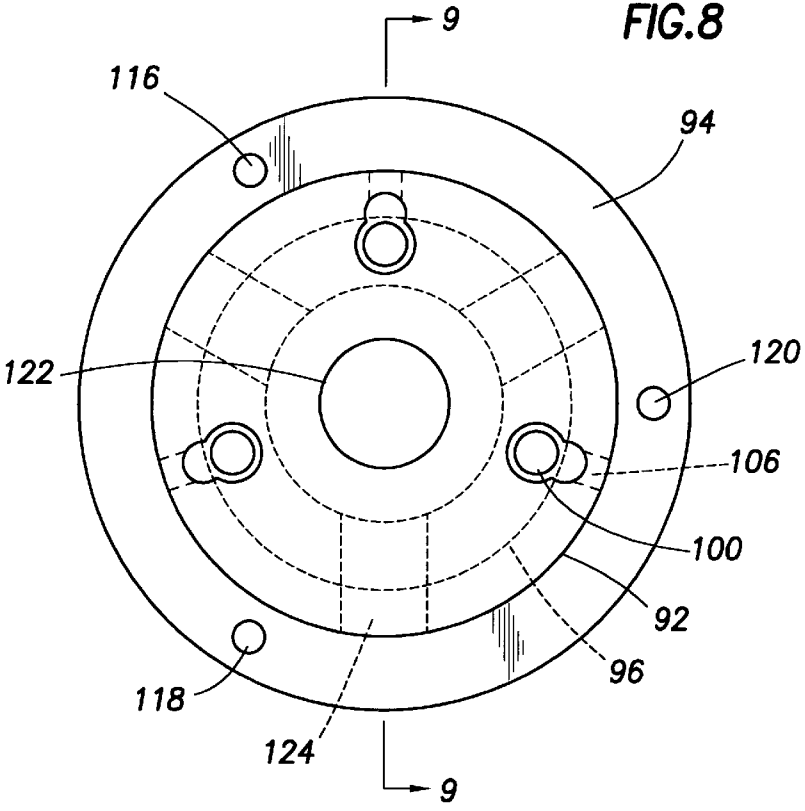
FIG. 8 is a top, plan view of a dual beacon flashtube socket.

FIG. 8 is a top, plan view of a dual beacon flashtube socket. Base 94 has holes 116, 118 and 120 drilled through the base 94. Opening 122 allows positioning of an elongated member or tube such as elongated member 110 shown in FIG. 7. Bore 124 extends inwardly from base 94. Section 92 has holes such as hole 106. Opening 100 extends through section 92 to recess 96.

Figure 9:
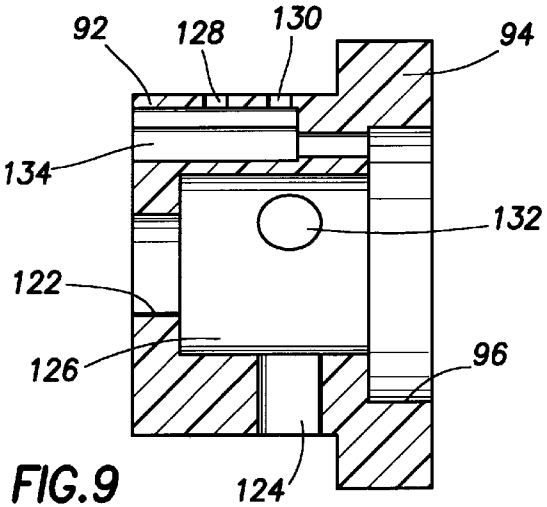
FIG. 9 is a sectional, side elevational view of a dual beacon flashtube socket taken along line 9—9 of FIG. 8.

FIG. 9 is a sectional, side elevational view of a dual beacon flashtube socket taken along line 9—9 of FIG. 8. Base 94 has recess 96 and opening 122. Bore 124 extends from the outer portion of base 94 inwardly to opening 126. Hole 128 and hole 130 are positioned in the outer portion of section 92. Hole 132 allows wires to pass through section 92 as explained in connection with FIG. 7. Opening 134 extends from recess 96 through section 92.

Thus it will be appreciated that the dual beacon arrangement of the present invention provides simplicity, economy, and reliability through a combination of elements acting in a new and useful manner to achieve a result not available prior to the present invention.

Although a preferred embodiment of the invention has been shown and described in accordance with the requirements of the United States Patent Laws, it will be appreciated by those skilled in the art to which the present invention pertains that modifications and improvements may be made without departing from the spirit of the invention defined by the following claims.

We claim:

1. A dual beacon including in combination an upper, substantially hollow cylindrical section having a first circular lens portion near the middle of said upper section and a top covering said upper section, A lower, substantially hollow cylindrical section having a second circular lens portion near the middle of said lower section, plate means hingedly connected to the upper portion of said lower section, upper flashtube means positioned above said plate means, lower flashtube means positioned below said plate means, and a plurality of feet connected to the bottom of said lower section, and pin means hingedly connecting said upper section and said lower section whereby hinged movement of said upper section allows hinged movement of said plate means in the same arcuate direction.

2. A dual beacon defined by claim 1 wherein said first circular lens portion and said second circular lens portion each provide a light pattern having peak intensity in an area of from one degree through five degrees above a horizontal reference plane and more than fifty percent of peak intensity is provided in a minus one degree area below the horizontal reference plane and less than three percent of peak intensity is provided at the minus ten degree area below the horizontal reference plane.

* * * * *